US006250511B1

(12) United States Patent
Kelly

(10) Patent No.: US 6,250,511 B1
(45) Date of Patent: Jun. 26, 2001

(54) RECHARGE INSERT FOR CLEANING, SANITIZING OR DISINFECTANT FLUID SPRAY SYSTEM

(76) Inventor: Albert R. Kelly, 2 Cedar La., Douglaston, NY (US) 11363

( * ) Notice: Subject to any disclaimer, the term of this patent is extended or adjusted under 35 U.S.C. 154(b) by 0 days.

(21) Appl. No.: 09/434,452

(22) Filed: Nov. 5, 1999

(51) Int. Cl.[7] ..... B67D 5/60

(52) U.S. Cl. ..... 222/382; 222/382; 222/383.1; 222/464.2; 15/104.93

(58) Field of Search ..... 222/382, 383.1, 222/464.2, 129, 130; 15/104.93

(56) References Cited

U.S. PATENT DOCUMENTS 4,418,846 * 12/1983 Pong et al. ..... 222/464.2
4,530,450 * 7/1985 Nandagirl ..... 222/464.2
5,091,102 * 2/1992 Sheridan ..... 15/104.93
5,529,216 * 6/1996 Klima et al. ..... 222/383.1

* cited by examiner

*Primary Examiner*—Philippe Derakshani
(74) *Attorney, Agent, or Firm*—Evelyn M. Sommer

(57) ABSTRACT

A recharge insert, for use with a spray dispenser device, is made of a matrix material impregnated with a chemical that is dry-to-the-touch and becomes dissolved in solution with a diluent fluid such as water. The recharge insert is formed in an elongated cylindrical shape with a center opening for mounting on the standard plastic downtube of the spray dispenser device. The insert sleeve may be formed with a side slit to open and wrap it around the downtube. When the spray bottle is filled with water, sealed, and shaken, the fluid penetrates into the matrix material, and the chemical composition becomes dissolved in solution, thereby creating a cleaning, sanitizing or disinfectant solution that will remain stable and fully active in use. The matrix material can be mounted on a hollow tubular carrier with lower spacer legs, or affixed to an upper retaining disk that is seated on the container neck for holding the insert clear of the lower intake end of the tube.

16 Claims, 2 Drawing Sheets

FIG. 1A
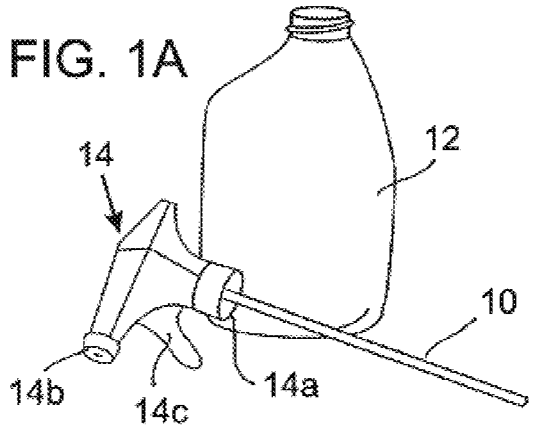
FIG. 1B
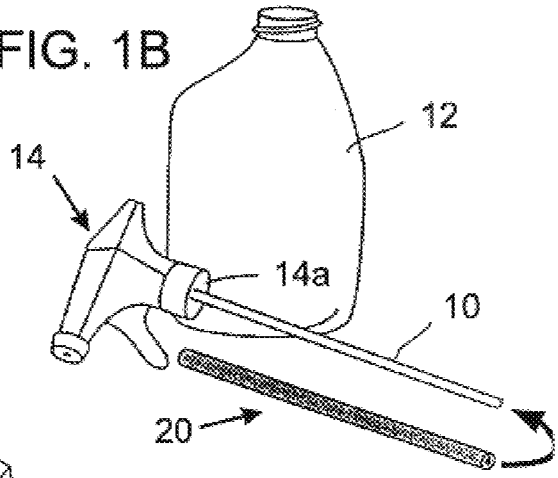
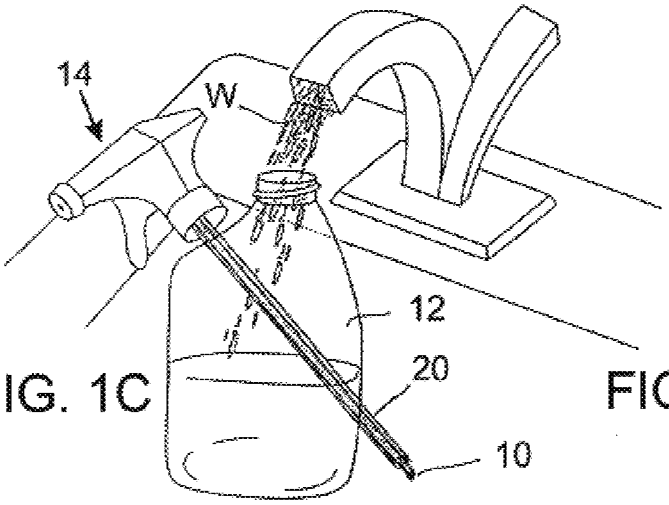
FIG. 1C
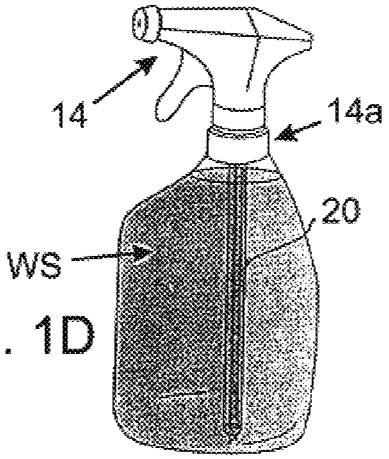
FIG. 1D
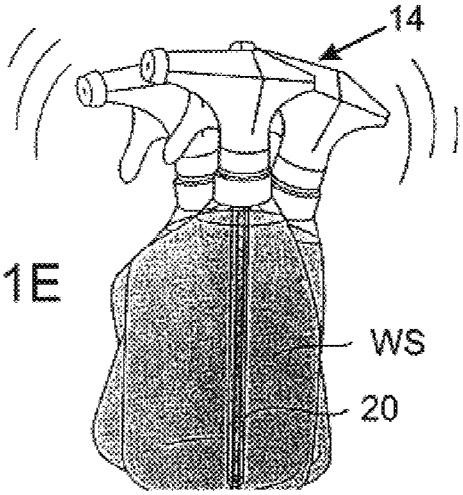
FIG. 1E
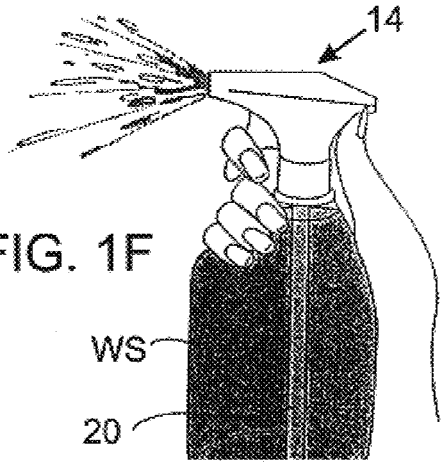
FIG. 1F

RECHARGE INSERT FOR CLEANING, SANITIZING OR DISINFECTANT FLUID SPRAY SYSTEM

TECHNICAL FIELD

This invention generally relates to spray bottle systems for dispensing cleaning, sanitizing or disinfectant fluids, and more particularly, to a recharge insert for use with such systems.

BACKGROUND OF INVENTION

Due to regulations curtailing the use of aerosol dispensers for chemical reagents that discharge foaming or pressurized gases or hydrocarbons into the atmosphere, the use of spray bottles that are manually pumped has become widespread. The typical spray bottle dispenser consists of a plastic container holding fluid with chemical reagent dissolved therein, which is sealed by a threaded cap mounting a sprayhead from which a downtube projects and extends downwardly into the body of the container. When the user operates a trigger on the sprayhead, the contents of the downtube are pumped up into the sprayhead and sprayed out from a directional orifice or nozzle.

Many vendors sell separately bottles of fluid for refilling the spray dispenser bottle, or for transferring the sprayhead thereto when the contents of the first-purchased dispenser bottle are used up, so that the sprayhead and bottle can be reused. Often, the refill bottles contain a large volume of fluid so that the original dispenser bottle can be refilled several times before another refill bottle needs to be purchased.

This widely used type of spray dispenser system has several problems which the present invention seeks to improve. One problem is that the refill bottles take up a lot of volume which incurs additional shipping costs, storage costs, and demand for shelf space. Another problem is that a refill bottle must be sold for the specific types of fluid it is intended to refill. Thus, if a vendor sells different formulations of the same cleaner (ordinary cleaning, high strength) or different types of cleaners under the same product name (lemon-scented, disinfecting, kitchen/bath tile cleaner), then a refill bottle must be sold for each grade and type of fluid.

A further problem is that pouring fluid from the refill bottle can incur spills or require potentially hazardous handling of caustic or toxic fluids. On the other hand, if the fluids must be made in very dilute concentrations for public safety in handling, then the cleaning ability or effectiveness of the product may be compromised. The refill bottles themselves are discarded after use, thus adding to plastic pollution and landfill waste.

There have been various proposals for providing a rechargeable insert holding chemical in concentrated form which can be used with a spray dispenser system. For example, U.S. Pat. Nos. 3,655,096, 3,966,089, 4,088,246, and 5,421,483 show a capsule or cartridge holding concentrated material which is secured in the neck of the bottle and released by threading the sealing cap or a ringnut against it to puncture its bottom walls against a sharp element or to squeeze the concentrate out. These types of puncturable or burst able cartridge systems are costly to fabricate, complicated to operate, and potentially hazardous if a problem occurs and the user must open the container and reposition or remove a failed cartridge.

U.S. Pat. No. 5,529,216 shows another rechargeable spray dispenser system in which an elongated insert having one or more concentrate-containing compartments is inserted in the bottle, and a sharp end of the downtube is used to puncture through upper and/or lower sealing membranes in order to release the concentrate into the diluent fluid (water) filled into the bottle. However, this type of recharge insert must be purchased with a sharp downtube, and cannot be used with an existing or currently marketed spray dispenser bottle that has a blunt downtube. Moreover, the sealing walls must be punctured by the user manipulating the downtube while the container is open, thereby presenting a risk that concentrate will be ejected under the pressure applied to the sealing walls back at the user.

SUMMARY OF INVENTION

In the present invention, a recharge insert, for use with a spray dispenser device having a container body, a sprayhead mounted with a sealing cap, and an elongated downtube which is inserted into the container body during use, is comprised of a matrix material impregnated with a non-aqueous chemical composition that is dry-to-the-touch and becomes dissolved in solution with a diluent fluid such as water. The recharge insert is formed in an elongated cylindrical shape with a center opening for mounting on the downtube. The matrix material has an outer surface which is porous to fluid filled into the container body so that the fluid can penetrate into the matrix material and dissolve the chemical composition impregnated therein.

In a preferred embodiment, the matrix material is a synthetic, binder-free, nonwoven substrate that is formed as a sleeve or tube with an opening along its center axis for inserting the downtube there through. Alternatively, the insert sleeve or tube can be formed with a side slit to open and wrap it around the downtube. The matrix substrate can be made of synthetic fibers that are bonded together without a chemical binder, such as by heat bonding, ultrasonic bonding, stitching, or mechanical or hydraulic entanglement, or an open-celled foam material. The cleaning, sanitizing or disinfectant chemical composition is impregnated in the matrix by coating or spraying the matrix material with a non aqueous treatment solution. The matrix material has a desired porosity to allow fluid to penetrate through the material and dissolve the chemical composition impregnated therein.

When the spray bottle is filled with water, sealed, and shaken, the chemical composition becomes dissolved in solution, thereby creating a cleaning, sanitizing or disinfectant solution that will remain stable and fully active. Other embodiments have various means for holding the insert in its retaining position clear of the intake end of the tube, so as not to block the flow of fluid therein.

Other objects, features, and advantages of the present invention will be explained in the following detailed description of the invention having reference to the appended drawings.

BRIEF DESCRIPTION OF DRAWINGS

FIGS. 1A to 1F illustrate a preferred embodiment of a recharge insert in accordance with the invention, and the steps for using it.

DETAILED DESCRIPTION OF INVENTION

Figure 2A:
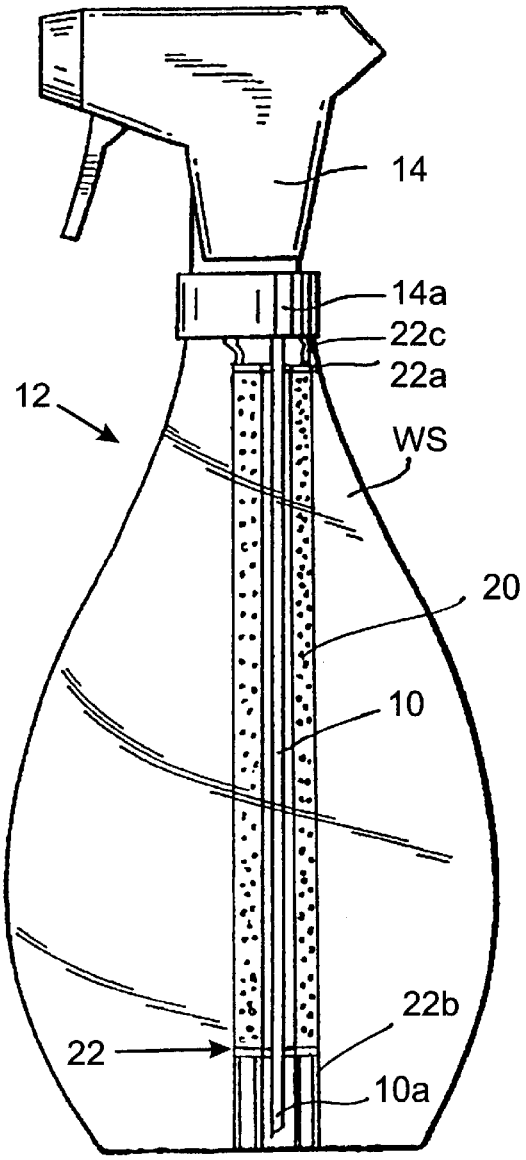
FIGS. 2A, 2B, and 2C illustrate other embodiments having various means for holding the recharge insert in a retaining position on the tube.

Referring to FIGS. 1A to 1F, a preferred embodiment of a recharge insert 20 in accordance with the present invention is illustrated for use with a standard spray dispenser device having a container body 12 for holding fluid, a sprayhead 14 mounted with a sealing cap 14*a*, spray trigger 14*b*, and spray orifice or nozzle 14*c*, and an elongated downtube 10 which is inserted into the body of the container 12 during use. The recharge insert 20 is comprised of a matrix material impregnated with a chemical composition that is dry-to-the-touch and becomes dissolved in solution with a diluent fluid such as commonly available tap water W.

The recharge insert 20 is formed in an elongated cylindrical shape with an opening along its center axis. when the original contents of the spray bottle are used up, the sealing cap is removed (typically by unthreading) from the container body. In the preferred embodiment, the recharge insert is mounted by sleeving it over the downtube 10 until the intake end of the downtube projects from the end of the insert 20. The insert opening is sized to fit snugly over a standard-sized plastic downtube of a spray dispenser so that it can stay in position on the downtube. When the spray bottle is filled with water W, sealed with the sealing cap 14*a*, and shaken, the chemical composition impregnated in the matrix material of the insert 20 becomes dissolved by the fluid to form a cleaning, sanitizing or disinfectant solution WS. As the fluid penetrates into the matrix material of the insert, the insert will also swell slightly, thereby applying a small holding pressure against the downtube.

The preferred matrix material is a synthetic, binder-free, nonwoven substrate that is formed as a sleeve or tube. The matrix substrate can be made of synthetic fibers that are bonded together without a chemical binder, such as by heat bonding, ultrasonic bonding, stitching, or mechanical or hydraulic entanglement. For example, the matrix can be made up of synthetic fibers processed into woven, knitted, or nonwoven forms, or synthetic fibers combined with natural fibers. The substrate can also be a flexible, open-celled foam material. Use of a chemical binder is avoided to prevent such chemicals from being dissolved by and leaching into the fluid, thereby contaminating or reducing the effectiveness of the cleaning, sanitizing or disinfectant solution. The inserts can be mass produced as a web with a series of tubular forms. The individual tubes may be defined along their sides by stitch bonding and readily separated from each other. The nonwoven substrate can be fabricated so that its outer surface has a desired porosity to allow fluid to readily penetrate into the matrix material and dissolve the chemical impregnated therein.

The desired cleaning, sanitizing or disinfectant chemical composition can be impregnated in the matrix material by any suitable means. For example, a simple chemical impregnation process is described in commonly owned U.S. Pat. No. 5,091,102 to Sheridan, which is incorporated in its entirety herein by reference. In the Sheridan process, the matrix substrate is coated with non aqueous treatment solution so that the resulting material is dry to the touch and has the desired amount of chemical composition impregnated therein so that it can be released by contact with water prior to use. The treatment solution may be applied anywhere in the range from 1% to 99%, preferably between about 3% to 25%, of basis weight of the matrix. The treatment solution can comprise between about 25% and 75% of at least one glycol compound, between 0.2% and 60% of an antimicrobial component, between about 5% and 45% of a surfactant, and optionally effective amounts of fragrances, dyes and other additives.

Figure 2B:
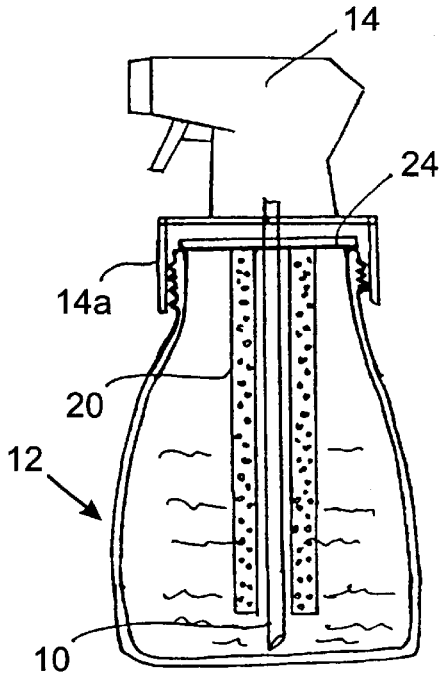
Figure 2C:
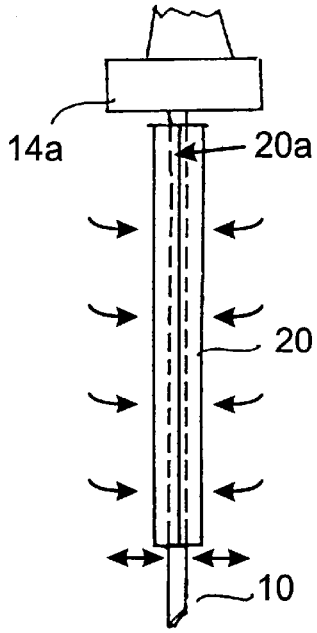

Other modes for mounting the recharge insert on the downtube of a standard spray dispenser are illustrated in FIGS. 2A–2C. In FIG. 2A, the insert 20 is mounted on a hollow tubular carrier 22 that has an upper retainer collar 22*a*, a lower retainer with spacer legs 22*b*, and a retrieval loop or tab 22*c*. To recharge the dispenser, the carrier 22 with recharge insert 20 mounted thereon is inserted into the open neck of the container bottle 12, and the cap 14*a* is sealed onto the bottle after inserting the downtube 10 into the hollow opening in the carrier 22. The spacer legs 22*b* of the carrier 22 have a height sufficient to position the recharge insert 20 above the end 10*a* of the downtube, to avoid blocking the flow of fluid therein.

In FIG. 2B, the upper end of the insert 20 is bonded or fixed to a plastic retaining disc 24 which has a diameter slightly larger than the inner diameter of the neck of the container bottle 12. To recharge the dispenser, the recharge insert 20 is inserted into the open neck of the container bottle 12 so that the retaining disk is seated on the upper edges of the bottle neck, and the cap 14*a* is sealed onto the bottle after inserting the downtube 10 into the hollow opening in the insert 10. The insert 10 has a length shorter than the length of the downtube to avoid blocking the flow of fluid into the intake end.

In FIG. 2C, a simple variation of the first-described insert embodiment is provided with a slit 20*a* running the length on one side of the tubular insert 20. The slit allows the insert to be installed more readily on the downtube 10 by opening the slit and wrapping the insert 20 around the downtube 10.

The invention thus provides a dry-to-the-touch recharge insert for allowing convenient re-use of a spray dispenser bottle. The recharge insert is an entirely self-contained unit which does not require any modification to standard spray dispenser devices for its use. The dry-to-the-touch recharge insert eliminates the need to ship, stock, and stack refill bottles for each type and grade of cleaning fluid of the original product. They are a fraction of the weight and volume of refills in solution, and can be manufactured at low cost. It can also be installed easily, without potential hazards to the user due to spillage, or puncturing or bursting of cartridges.

It is to be understood that many modifications and variations may be devised given the above description of the principles of the invention. It is intended that all such modifications and variations be considered as within the spirit and scope of this invention, as defined in the following claims.

I claim:

1. A recharge insert for use with a spray dispenser device having a container body, a spray head removably mounted with a sealing cap to said container body and an elongated down tube connected to said spray head which is inserted into and extends into the container body during use, comprising a matrix material, said matrix comprising (a) natural or synthetic woven or non-woven or knitted fibers or (b) flexible foam material or (c) combinations thereof, impregnated with a chemical composition so that the matrix material remains dry to the touch, said chemical composition being capable of being dissolved in solution with a diluent fluid, said recharge insert being formed in an elongated cylindrical shape with a center opening for mounting on said down tube, said recharge insert having an outer surface which is porous to fluid filled into the container body so that fluid can penetrate into the matrix material and dissolve the chemical composition impregnated therein into a solution in the fluid, said recharge insert being adapted for removal when spent and being replaced with another impregnated insert.

2. A recharge insert according to claim 1, wherein the matrix material is formed as a sleeve or tube with an opening along its center axis for inserting the downtube there through.

3. A recharge insert according to claim 1, wherein the matrix material is formed as a sleeve or tube with a side slit to allow it to be opened and wrapped around the downtube.

4. A recharge insert according to claim 1, wherein the recharge insert further comprises a retaining disk to which the matrix material is affixed, said retaining disk having a diameter larger than an inner diameter of a neck opening in the container body to allow the retaining disk to be seated thereon, and having a length shorter than a lower intake end of the downtube.

5. A recharge insert according to claim 1, wherein the recharge insert further comprises a hollow tubular carrier having on which the matrix material is carried, said carrier a central opening for inserting the downtube there through and spacer legs at a lower end thereof having a height sufficient for holding the matrix material above a lower intake end of the downtube.

6. A recharge insert according to claim 1, wherein the matrix material is a synthetic, binder-free, nonwoven substrate.

7. A recharge insert according to claim 1, wherein the matrix material is an open-celled foam material.

8. A recharge insert according to claim 1, wherein the matrix material is formed as an individual tube substrate that is stitch bonded along its sides.

9. A spray dispenser system comprising a container body for containing diluent fluid therein a spray head removably mounted with a sealing cap to said container body and an elongated down tube connected to said spray head which is inserted into and extends into the container body during use, a recharge insert comprising a matrix material, said matrix comprising (a) natural or synthetic woven or non-woven or knitted fibers or (b) flexible foam material or (c) combinations thereof, impregnated with a chemical composition so that the matrix material remains dry to the touch, said chemical composition being capable of being dissolved in solution with a diluent fluid, said recharge insert being formed in an elongated cylindrical shape with a center opening for mounting on said down tube, said recharge insert having an outer surface which is porous to fluid filled into the container body so that fluid can penetrate into the matrix materials and dissolve the chemical composition impregnated therein into a solution in the fluid, said recharge insert being adapted for removal when spent and being replaced with another impregnated insert.

10. A spray dispenser system according to claim 9, wherein the matrix material is formed as a sleeve or tube with an opening along its center axis for inserting the downtube there through.

11. A spray dispenser system according to claim 9, wherein the matrix material is formed as a sleeve or tube with a side slit to allow it to be opened and wrapped around the downtube.

12. A spray dispenser system according to claim 9, wherein the recharge insert further comprises a retaining disk to which the matrix material is affixed, said retaining disk having a diameter larger than an inner diameter of the neck opening in the container body to allow the retaining disk to be seated thereon, and having a length shorter than a lower intake end of the downtube.

13. A spray dispenser system according to claim 9, wherein the recharge insert further comprises a hollow tubular carrier on which the matrix material is carried, said carrier a central opening for inserting the downtube there through and spacer legs at a lower end thereof having a height sufficient for holding the matrix material above a lower intake end of the downtube.

14. A spray dispenser system according to claim 9, wherein the matrix material is a synthetic, binder-free, nonwoven substrate.

15. A spray dispenser system according to claim 9, wherein the matrix material is an open-celled foam material.

16. A spray dispenser system according to claim 9, wherein the matrix material is formed as an individual tube substrate that is stitch bonded along its sides.

* * * * *